US010354590B2

(12) United States Patent
Nie et al.

(10) Patent No.: US 10,354,590 B2
(45) Date of Patent: Jul. 16, 2019

(54) HYBRID COMPENSATION CIRCUIT AND METHOD FOR OLED PIXEL

(71) Applicant: Shenzhen China Star Optoelectronics Technology Co., Ltd., Shenzhen (CN)

(72) Inventors: Chenglei Nie, Shenzhen (CN); Yuanchun Wu, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 326 days.

(21) Appl. No.: 15/505,097

(22) PCT Filed: Dec. 20, 2016

(86) PCT No.: PCT/CN2016/110903
§ 371 (c)(1),
(2) Date: Feb. 19, 2017

(87) PCT Pub. No.: WO2018/068393
PCT Pub. Date: Apr. 19, 2018

(65) Prior Publication Data
US 2019/0156747 A1 May 23, 2019

(51) Int. Cl.
*G09G 3/3258* (2016.01)
*G09G 3/3233* (2016.01)
(Continued)

(52) U.S. Cl.
CPC ..... *G09G 3/3258* (2013.01); *G09G 3/3233* (2013.01); *G09G 3/3266* (2013.01); *G09G 3/3275* (2013.01); *G09G 2300/043* (2013.01)

(58) Field of Classification Search
CPC .. G09G 3/3258; G09G 3/3233; G09G 3/3241; G09G 3/325; G09G 3/3266;
(Continued)

(56) References Cited

U.S. PATENT DOCUMENTS 8,405,579 B2 * 3/2013 Choi ..... G09G 3/3283 345/30
8,547,309 B2 * 10/2013 Byun ..... G09G 3/3233 315/169.3
(Continued)

*Primary Examiner* — Tom V Sheng
(74) *Attorney, Agent, or Firm* — Leong C. Lei

(57) ABSTRACT

The invention discloses a hybrid compensation circuit and method for OLED pixel, by using a pixel internal driver circuit (100) of 4T1C structure to compensate threshold voltage of driving TFT using the source follow approach to achieve fast compensation; and in driving light-emitting phase, using an external compensation circuit (200) to detect the current flowing through the OLED (D1), comparing, computing and storing the difference between the current flowing through the OLED (D1) and a pre-defined current; when the corresponding row of pixel internal driver circuits (100) entering the threshold voltage programming design phase again, performing compensation on the data signal (Data), correcting compensation result so that the current flowing through the OLED (D1) is closer to the pre-defined current to achieve large compensation range.

12 Claims, 6 Drawing Sheets

(51) Int. Cl.
*G09G 3/3275* (2016.01)
*G09G 3/3266* (2016.01)

(58) Field of Classification Search
CPC ..... G09G 3/3275; G09G 2300/043; G09G 2310/0243; G09G 2310/0251; G09G 2310/0262; G09G 2310/0264; G09G 2310/0267; G09G 2320/043
See application file for complete search history.

(56) References Cited

U.S. PATENT DOCUMENTS

2002/0105279 A1* 8/2002 Kimura ..... G09G 3/3233 315/169.3
2008/0238834 A1* 10/2008 Matsuo ..... G09G 3/3233 345/76
2010/0097360 A1* 4/2010 Cho ..... G09G 3/325 345/205
2011/0130981 A1* 6/2011 Chaji ..... G09G 3/006 702/58
2017/0372655 A1* 12/2017 Wang ..... G09G 3/3233

* cited by examiner

HYBRID COMPENSATION CIRCUIT AND METHOD FOR OLED PIXEL

BACKGROUND OF THE INVENTION

1. Field of the Invention

The present invention relates to the field of display techniques, and in particular to a hybrid compensation circuit and method for OLED pixel.

2. The Related Arts

The organic light emitting diode (OLED) display provides the advantages of active light-emitting, low driving voltage, high emission efficiency, quick response time, high resolution and contrast, near 180° viewing angle, wide operation temperature range, and capability to realize flexible display and large-area full-color display, and is regarded as the most promising display technology.

The driving types of OLED can be divided, according to the driving method, into the passive matrix OLED (PMOLED) and active matrix OLED (AMOLED), i.e., the direct addressable type and thin film transistor (TFT) addressable type, wherein the AMOLED provides the advantages of pixels arranged in an array, self-luminous, and high luminous efficiency and is commonly used for high definition large-size display.

AMOLED is a current-driven device that emits light when a current flows through the OLED, and the light-emitting luminance is determined by the current flowing through the OLED. Most of the known integrated circuits (ICs) only transmit voltage signals, so the AMOLED pixel driver circuit needs to complete the task of converting the voltage signal into a current signal.

The known AMOLED pixel driver circuit is usually of 2T1C structure, that is, two thin film transistors (TFTs) and a capacitor, to convert voltage to current, but the traditional 2T1C pixel driver circuit generally does not provide a compensation function. Wherein, one of the TFTs is a switching TFT used to control the entry of data signals. The other TFT is a driving TFT for controlling the current through the OLED, thus the importance of the threshold voltage of the driving TFT is obvious. The positive or negative drift of the threshold voltage will cause different currents to pass through the OLED under the same data signal. However, the threshold voltage drift of TFTs produced by low temperature polysilicon (LTPS) or oxide semiconductors is affected by the light, the source and the drain voltage stress, and so on, resulting in threshold voltage drift. In traditional 2T1C circuits, the threshold voltage drift of the driving TFT cannot be improved by regulating, and the ageing of OLED will cause the threshold voltage drift in the course of using. Threshold voltage drift will lead to problems of instability of the current through the OLED, panel brightness unevenness, so it is necessary to use different methods to compensate the threshold voltage drift of the driving TFT and OLED.

In the known techniques, the approaches of compensating the threshold voltage drift of the driving TFT include internal compensation and external compensation. The approach of realizing the threshold voltage compensation simply by adding new TFTs and signal lines inside the pixels is called internal compensation. The internal compensation process is relatively simple and the operation speed is faster, but the circuit of the pixel is complex and the compensation range is limited; the approach using an IC external to the panel to compensate the threshold voltage is called external compensation, the pixel circuit is relatively simple, and the compensation range is relatively large; but the compensation process is complex, and the operation speed is slow.

SUMMARY OF THE INVENTION

The object of the present invention is to provide a hybrid compensation circuit for OLED pixel, combining the advantages of the fast operations of internal compensation and the wide compensation range of the external compensation, able to more effectively compensate the threshold voltage drift of the driving TFT and the threshold voltage drift of the OLED due to ageing.

Another object of the present invention is to provide a hybrid compensation method for OLED pixel, able to perform internal and external compensations simultaneously to achieve effective compensation, fast compensation operation and large compensation range.

To achieve the above object, the present invention provides a hybrid compensation circuit for OLED pixel, which comprises: a plurality of pixel internal driver circuits arranged in an array, and an external compensation circuit electrically connected respectively to each row of the plurality of pixel internal driver circuits;

each pixel internal driver circuit comprising: a first thin film transistor (TFT), a second TFT, a third TFT, a fourth TFT, a first capacitor, and an organic light-emitting diode (OLED);

the first TFT having the gate connected to a first node, the source connected to a second node and the drain connected to a voltage power supply;

the second TFT having the gate connected to a first scan signal, the source connected to a data signal and the drain connected to the first node;

the third TFT having the gate connected to a second scan signal, the source connected to an initialization voltage and the drain connected to the first node;

the fourth TFT having the gate connected to the second scan signal, the source connected to the initialization voltage and the drain connected to the second node;

the first capacitor having one end connected to the first node and the other end connected to the second node;

the OLED having the anode connected to the second node and the cathode connected to the ground;

each external compensation circuit comprising: an analog-to-digital converter (ADC), a current comparator, a control module, a memory, and a digital-to-analog converter (DAC);

the ADC having the input end connected to the drain of the first TFT of corresponding row of pixel internal driver circuits, and the output end connected to the input end of the current comparator;

the current comparator having the output end connected to the input end of the control module;

the control module having the output end connected to the input end of the memory; the memory having the output end connected to the input end of the DAC;

the DAC having the output end connected to the source of the second TFT of corresponding row of pixel internal driver circuits.

According to a preferred embodiment of the present invention, the external compensation circuit further comprises an operational amplifier and a second capacitor;

the operational amplifier has the first input end connected to the drain of the first TFT of the pixel internal driver circuit, the second input end connected to the ground, and the output end connected to the input end of the ADC;

the second capacitor having one end connected to the first input end of the operational amplifier and the other end connected to the output end of the operational amplifier.

According to a preferred embodiment of the present invention, the first TFT, the second TFT, the third TFT and the fourth TFT are all low temperature polysilicon (LTPS) TFTs, oxide semiconductor TFTs or amorphous silicon (a-Si) TFTs;

the first scan signal and the second scan signal are both provided by an external timing controller.

According to a preferred embodiment of the present invention, the first scan signal, the second scan signal and the data signal are combined to correspond, in series, to a reset phase, a threshold voltage detection phase, a threshold voltage programming design phase and a driving light-emitting phase;

in the reset phase, the first scan signal provides low voltage, the second scan signal provides high voltage and the data signal provides low voltage;

in the threshold voltage detection phase, the first scan signal provides high voltage, the second scan signal provides low voltage and the data signal provides a reference high voltage;

in the threshold voltage programming design phase, the first scan signal provides high voltage, the second scan signal provides low voltage and the data signal provides a display data signal high voltage;

in the driving light-emitting phase, the first scan signal, the second scan signal and the data signal all provide low voltage.

According to a preferred embodiment of the present invention, the reference high voltage is lower than the display data signal high voltage.

Another embodiment of the present invention provides a hybrid compensation method for OLED pixel, which comprises:

Step 1: providing a hybrid compensation circuit for OLED pixel;

the hybrid compensation circuit comprising: a plurality of pixel internal driver circuits arranged in an array, and an external compensation circuit electrically connected respectively to each row of the plurality of pixel internal driver circuits;

each pixel internal driver circuit comprising: a first thin film transistor (TFT), a second TFT, a third TFT, a fourth TFT, a first capacitor, and an organic light-emitting diode (OLED);

the first TFT having the gate connected to a first node, the source connected to a second node and the drain connected to a voltage power supply;

the second TFT having the gate connected to a first scan signal, the source connected to a data signal and the drain connected to the first node;

the third TFT having the gate connected to a second scan signal, the source connected to an initialization voltage and the drain connected to the first node;

the fourth TFT having the gate connected to the second scan signal, the source connected to the initialization voltage and the drain connected to the second node;

the first capacitor having one end connected to the first node and the other end connected to the second node;

the OLED having the anode connected to the second node and the cathode connected to the ground;

each external compensation circuit comprising: an analog-to-digital converter (ADC), a current comparator, a control module, a memory, and a digital-to-analog converter (DAC);

the ADC having the input end connected to the drain of the first TFT of corresponding row of pixel internal driver circuits, and the output end connected to the input end of the current comparator;

the current comparator having the output end connected to the input end of the control module;

the control module having the output end connected to the input end of the memory; the memory having the output end connected to the input end of the DAC;

the DAC having the output end connected to the source of the second TFT of corresponding row of pixel internal driver circuits;

Step 2: entering reset phase:

the first scan signal providing low voltage to cut off the second TFT, the second scan signal providing high voltage to turn on the third TFT and the fourth TFT, the initialization voltage being written into the first node (i.e., the gate of the first TFT) and the second node (i.e., the source of the first TFT), and the data signal providing low voltage;

Step 3: entering threshold voltage detection phase:

the first scan signal providing high voltage to turn on the second TFT, the second scan signal providing low voltage to cut off the third TFT and the fourth TFT, the data signal providing a reference high voltage Vref, the first node (i.e., the gate of the first TFT) being written into with the reference high voltage and the second node (i.e., the source of the first TFT) becoming Vref−Vth, with Vth being the threshold voltage of the first TFT;

Step 4: entering threshold voltage programming design phase:

the first scan signal providing high voltage to turn on the second TFT, the second scan signal providing low voltage to cut off the third TFT and the fourth TFT, the data signal providing a display data signal high voltage, the first node (i.e., the gate of the first TFT) being written into with the display data signal high voltage and the second node (i.e., the source of the first TFT) becoming Vref−Vth+ΔV, with ΔV being influence on the second node caused by the display data signal high voltage;

Step 5: entering driving light-emitting phase:

the first scan signal, the second scan signal and the data signal all providing low voltage, the second TFT, the third TFT and the fourth TFT all cut off, the voltage difference between the first node and the second node remaining unchanged due to storage effect of the first capacitor; the OLED emitting light and current flowing through the OLED independent of the threshold voltage of the first TFT;

the ADC also receiving and converting the current flowing through the OLED by the corresponding row of pixel internal driver circuits to obtain an actual current detection signal, the current comparator comparing the actual current detection signal with a pre-defined current corresponding signal, the control module computing the difference between the actual current detection signal and the pre-defined current corresponding signal and storing the difference in the memory;

Step 6: when the corresponding row of pixel internal driver circuits entering the threshold voltage programming design phase again, the memory outputting the stored difference to the DAC for conversion and performing compensation on the data signal.

According to a preferred embodiment of the present invention, the external compensation circuit further comprises an operational amplifier and a second capacitor;

the operational amplifier has the first input end connected to the drain of the first TFT of the pixel internal driver circuit, the second input end connected to the ground, and the output end connected to the input end of the ADC;

the second capacitor having one end connected to the first input end of the operational amplifier and the other end connected to the output end of the operational amplifier;

in Step 5, the current flowing the OLED by the corresponding row of pixel internal driver circuits is amplified by the operational amplifier and outputted to the input end of the ADC.

According to a preferred embodiment of the present invention, the first TFT, the second TFT and the third TFT are all low temperature polysilicon (LTPS) TFTs, oxide semiconductor TFTs or amorphous silicon (a-Si) TFTs;

the first scan signal and the second scan signal are both provided by an external timing controller.

According to a preferred embodiment of the present invention, the reference high voltage is lower than the display data signal high voltage.

Yet another embodiment of the present invention provides a hybrid compensation circuit for OLED pixel, which comprises: a plurality of pixel internal driver circuits arranged in an array, and an external compensation circuit electrically connected respectively to each row of the plurality of pixel internal driver circuits;

each pixel internal driver circuit comprising: a first thin film transistor (TFT), a second TFT, a third TFT, a fourth TFT, a first capacitor, and an organic light-emitting diode (OLED);

the first TFT having the gate connected to a first node, the source connected to a second node and the drain connected to a voltage power supply;

the second TFT having the gate connected to a first scan signal, the source connected to a data signal and the drain connected to the first node;

the third TFT having the gate connected to a second scan signal, the source connected to an initialization voltage and the drain connected to the first node;

the fourth TFT having the gate connected to the second scan signal, the source connected to the initialization voltage and the drain connected to the second node;

the first capacitor having one end connected to the first node and the other end connected to the second node;

the OLED having the anode connected to the second node and the cathode connected to the ground;

each external compensation circuit comprising: an analog-to-digital converter (ADC), a current comparator, a control module, a memory, and a digital-to-analog converter (DAC);

the ADC having the input end connected to the drain of the first TFT of corresponding row of pixel internal driver circuits, and the output end connected to the input end of the current comparator;

the current comparator having the output end connected to the input end of the control module;

the control module having the output end connected to the input end of the memory;

the memory having the output end connected to the input end of the DAC;

the DAC having the output end connected to the source of the second TFT of corresponding row of pixel internal driver circuits;

wherein the external compensation circuit further comprising an operational amplifier and a second capacitor;

the operational amplifier has the first input end connected to the drain of the first TFT of the pixel internal driver circuit, the second input end connected to the ground, and the output end connected to the input end of the ADC;

the second capacitor having one end connected to the first input end of the operational amplifier and the other end connected to the output end of the operational amplifier;

wherein the first TFT, the second TFT and the third TFT being all low temperature polysilicon (LTPS) TFTs, oxide semiconductor TFTs or amorphous silicon (a-Si) TFTs;

the first scan signal and the second scan signal being both provided by an external timing controller.

Compared to the known techniques, the present invention provides the following advantages. The present invention provides a hybrid compensation circuit and method for OLED pixel, by using a pixel internal driver circuit of 4T1C structure to compensate threshold voltage of driving TFT using the source follow approach to achieve fast compensation; and in driving light-emitting phase, using an external compensation circuit to detect the current flowing through the OLED, comparing, computing and storing the difference between the current flowing through the OLED and a pre-defined current; when the corresponding row of pixel internal driver circuits entering the threshold voltage programming design phase again, performing compensation on the data signal, correcting compensation result so that the current flowing through the OLED is closer to the pre-defined current to achieve large compensation range.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technique means and effect of the present invention, the following uses preferred embodiments and drawings for detailed description.

Figure 1:
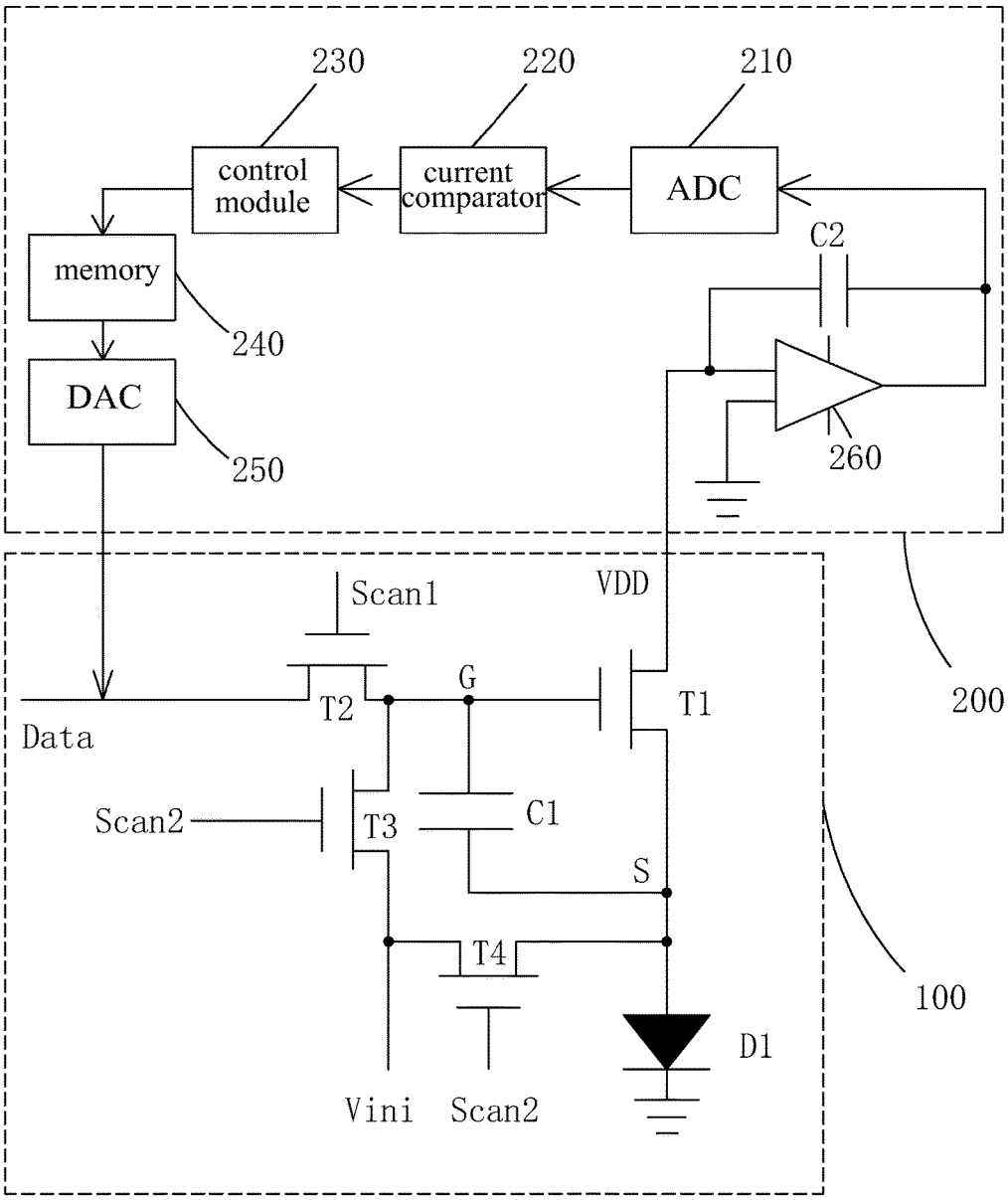
FIG. 1 is a schematic view showing a hybrid compensation circuit for OLED pixel provided by an embodiment of the present invention.
Figure 2:
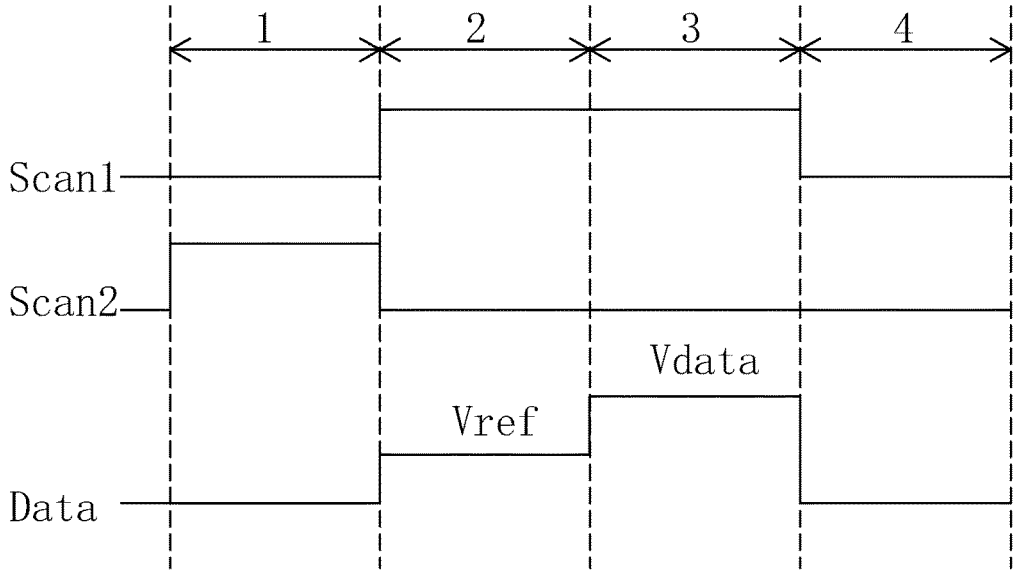
FIG. 2 is a schematic view showing the timing of the hybrid compensation circuit for OLED pixel provided by an embodiment of the present invention

Referring to FIG. 1 and FIG. 2, the present invention provides a hybrid compensation circuit for OLED pixel, which comprises: a plurality of pixel internal driver circuits 100 arranged in an array, and an external compensation circuit 200 electrically connected respectively to each row of the plurality of pixel internal driver circuits 100.

Refer to FIG. 1. Each pixel internal driver circuit comprises: a first thin film transistor (TFT) T1, a second TFT T2, a third TFT T3, a fourth TFT T4, a first capacitor C1, and an organic light-emitting diode (OLED) D1. The first TFT T1 has the gate connected to a first node G, the source connected to a second node S and the drain connected to a voltage power supply VDD. The first TFT T1 acts as a driving TFT. The second TFT T2 has the gate connected to a first scan signal Scan1, the source connected to a data signal Data and the drain connected to the first node G; the third TFT T3 has the gate connected to a second scan signal Scan2, the source connected to an initialization voltage Vini and the drain connected to the first node G; the fourth T4 TFT has the gate connected to the second scan signal Scan2, the source connected to the initialization voltage Vini and the drain connected to the second node S; the first capacitor C1 has one end connected to the first node G and the other end connected to the second node S; the OLED D1 has the anode connected to the second node S and the cathode connected to the ground.

Refer to FIG. 1. Each external compensation circuit 200 comprises: an analog-to-digital converter (ADC) 210, a current comparator 220, a control module 230, a memory 240, and a digital-to-analog converter (DAC) 250. The ADC 210 has the input end connected to the drain of the first TFT T1 of corresponding row of pixel internal driver circuits 100, and the output end connected to the input end of the current comparator 220; the current comparator 220 has the output end connected to the input end of the control module 230; the control module 230 has the output end connected to the input end of the memory 240; the memory 240 has the output end connected to the input end of the DAC 250; and the DAC 250 has the output end connected to the source of the second TFT T2 of corresponding row of pixel internal driver circuits 100.

Moreover, the external compensation circuit 200 further comprises an operational amplifier 260 and a second capacitor C2 corresponding to each row of pixel internal driver circuits 100. The operational amplifier 260 has the first input end connected to the drain of the first TFT T1 of the pixel internal driver circuit 100, the second input end connected to the ground, and the output end connected to the input end of the ADC 210; the second capacitor C2 has one end connected to the first input end of the operational amplifier 260 and the other end connected to the output end of the operational amplifier 260. The second capacitor C2 has a feedback effect for the input/output of the operational amplifier 260.

Specifically, the first TFT T1, the second TFT T2, the third TFT T3 and the fourth TFT T4 are all low temperature polysilicon (LTPS) TFTs, oxide semiconductor TFTs or amorphous silicon (a-Si) TFTs.

Specifically, the first scan signal Scan1 and the second scan signal Scan2 are both provided by an external timing controller.

Specifically, the first scan signal Scan1, the second scan signal Scan2 and the data signal Data are combined to correspond, in series, to a reset phase 1, a threshold voltage detection phase 2, a threshold voltage programming design phase 3 and a driving light-emitting phase 4. In the reset phase 1, the first scan signal Scan1 provides low voltage, the second scan signal Scan2 provides high voltage and the data signal Data provides low voltage; in the threshold voltage detection phase 2, the first scan signal Scan1 provides high voltage, the second scan signal Scan2 provides low voltage and the data signal Data provides a reference high voltage Vref; in the threshold voltage programming design phase 3, the first scan signal Scan1 provides high voltage, the second scan signal Scan2 provides low voltage and the data signal Data provides a display data signal high voltage Vdata; in the driving light-emitting phase 4, the first scan signal Scan1, the second scan signal Scan2 and the data signal Data all provide low voltage.

Moreover, the reference high voltage Vref is lower than the display data signal high voltage Vdata.

Refer to FIGS. 3-6, as well as FIGS. 1-2. The operation of the hybrid compensation circuit for OLED pixel of the present invention is as follows:

In reset phase 1: the first scan signal Scan1 provides low voltage to cut off the second TFT T2, the second scan signal Scan2 provides high voltage to turn on the third TFT T3 and the fourth TFT T4, and the data signal Data provides low voltage. The initialization voltage Vini is written into the first node G (i.e., the gate of the first TFT T1) and the second node S (i.e., the source of the first TFT T1) via the third and fourth TFTs T3, T4. In other words, the initialization voltage Vini is written into the gate and source of the first TFT, which is the driving TFT, to reset the gate voltage of the first TFT T1.

In threshold voltage detection phase 2: the first scan signal Scan1 provides high voltage to turn on the second TFT T2, the second scan signal Scan2 provides low voltage to cut off the third TFT T3 and the fourth TFT T4, the data signal Data provides a reference high voltage Vref, the first node G (i.e., the gate of the first TFT T1) is written into with the reference high voltage Vref and, with a source follow approach, the second node S(i.e., the source of the first TFT T2) becomes Vref−Vth, wherein Vth is the threshold voltage of the first TFT T1.

In threshold voltage programming design phase 3: the first scan signal Scan1 provides high voltage to turn on the second TFT T2, the second scan signal Scan2 provides low voltage to cut off the third TFT T3 and the fourth TFT T4, the data signal Data provides a display data signal high voltage Vdata, the first node G (i.e., the gate of the first TFT T1) is written into with the display data signal high voltage Vdata and the second node S (i.e., the source of the first TFT T1) becomes Vref−Vth+ΔV, wherein ΔV is influence on the second node caused by the display data signal high voltage, and is only related to the display data signal high voltage Vdata and the equivalent capacitance of OLED D1, and not related o the threshold voltage of the first TFT T1.

In driving light-emitting phase 4: the first scan signal Scan1, the second scan signal Scan2 and the data signal Data all provide low voltage, the second TFT T2, the third TFT T3 and the fourth TFT T4 are all cut off, the voltage difference between the first node G and the second node S remains unchanged due to storage effect of the first capacitor C1. In other words, the voltage between the gate and the source of the first TFT T1 remains unchanged, and the OLED d1 emits light.

Moreover, the equation to compute the current flowing through the OLED is known as::

$$I=1/2Cox(\mu W/L)\ (Vgs-Vth)^2 \quad (1)$$

Wherein I is the current flowing through the OLED, p is the carrier migration rate of the driving TFT, W and L are the width and length of channel of the driving TFT, Vgs is the voltage difference between the gate and the source of the driving TFT, and Vth is the threshold voltage of the driving TFT.

And, $$Vgs==V\text{data}-(V\text{ref}-Vth+\Delta V) \quad (2)$$

Substituting (2) into equation (1) to obtain:

$$I = 1/2Cox(\mu W/L)(Vdata - Vref + Vth - \Delta V - Vth)^2$$
$$= 1/2Cox(\mu W/L)(Vdata - Vref - \Delta V)^2$$

As shown, the current flowing through the OLED D1 is independent of the threshold voltage of the first TFT T1, which achieves effective compensation for the threshold voltage change in the first TFT T1, Also, because the pixel internal driver circuit 100 uses internal compensation, the compensation speed is fast to ensure the luminance evenness of the OLED and improve the display result.

In the driving light-emitting phase 4, the ADC 210 of the external compensation circuit 200 also receives the current flowing through the OLED D1 by the corresponding row of pixel internal driver circuits 100, and the ADC 210 converts the current to obtain an actual current detection signal. The current comparator 220 compares the actual current detection signal with a pre-defined current corresponding signal. When a difference exists, the control module 230 computes the difference between the actual current detection signal and the pre-defined current corresponding signal and stores the difference in the memory 240.

Then, when the corresponding row of pixel internal driver circuits 100 enters the threshold voltage programming design phase again, the memory 240 outputs the stored difference to the DAC 250 for conversion to perform compensation on the data signal Data so that the current flowing through the OLED d1 is closer to the pre-defined current. Because the external compensation circuit uses external compensation approach, the compensation range is large and able to rectify the compensation result of the pixel internal driver circuit 100 to further ensure the luminance evenness of the OLED and improve display quality.

Refer to FIGS. 3-6, as well as FIGS. 1-2. Based on the above hybrid compensation circuit for OLED pixel, the present invention also provides a hybrid compensation method for OLED pixel, which comprises:

Step 1: providing a hybrid compensation circuit for OLED pixel.

The hybrid compensation circuit for OLED pixel comprises: a plurality of pixel internal driver circuits 100 arranged in an array, and an external compensation circuit 200 electrically connected respectively to each row of the plurality of pixel internal driver circuits 100.

Refer to FIG. 1. Each pixel internal driver circuit comprises: a first thin film transistor (TFT) T1, a second TFT T2, a third TFT T3, a fourth TFT T4, a first capacitor C1, and an organic light-emitting diode (OLED) D1. The first TFT T1 has the gate connected to a first node G, the source connected to a second node S and the drain connected to a voltage power supply VDD. The first TFT T1 acts as a driving TFT. The second TFT T2 has the gate connected to a first scan signal Scan1, the source connected to a data signal Data and the drain connected to the first node G; the third TFT T3 has the gate connected to a second scan signal Scan2, the source connected to an initialization voltage Vini and the drain connected to the first node G; the fourth T4 TFT has the gate connected to the second scan signal Scan2, the source connected to the initialization voltage Vini and the drain connected to the second node S; the first capacitor C1 has one end connected to the first node G and the other end connected to the second node S; the OLED D1 has the anode connected to the second node S and the cathode connected to the ground.

Refer to FIG. 1. Each external compensation circuit 200 comprises: an analog-to-digital converter (ADC) 210, a current comparator 220, a control module 230, a memory 240, and a digital-to-analog converter (DAC) 250. The ADC 210 has the input end connected to the drain of the first TFT T1 of corresponding row of pixel internal driver circuits 100, and the output end connected to the input end of the current comparator 220; the current comparator 220 has the output end connected to the input end of the control module 230; the control module 230 has the output end connected to the input end of the memory 240; the memory 240 has the output end connected to the input end of the DAC 250; and the DAC 250 has the output end connected to the source of the second TFT T2 of corresponding row of pixel internal driver circuits 100.

Moreover, the external compensation circuit 200 further comprises an operational amplifier 260 and a second capacitor C2 corresponding to each row of pixel internal driver circuits 100. The operational amplifier 260 has the first input end connected to the drain of the first TFT T1 of the pixel internal driver circuit 100, the second input end connected to the ground, and the output end connected to the input end of the ADC 210; the second capacitor C2 has one end connected to the first input end of the operational amplifier 260 and the other end connected to the output end of the operational amplifier 260. The second capacitor C2 has a feedback effect for the input/output of the operational amplifier 260.

Specifically, the first TFT T1, the second TFT T2, the third TFT T3 and the fourth TFT T4 are all low temperature polysilicon (LTPS) TFTs, oxide semiconductor TFTs or amorphous silicon (a-Si) TFTs.

Specifically, the first scan signal Scan1 and the second scan signal Scan2 are both provided by an external timing controller.

Step 2: entering reset phase 1.

Figure 3:
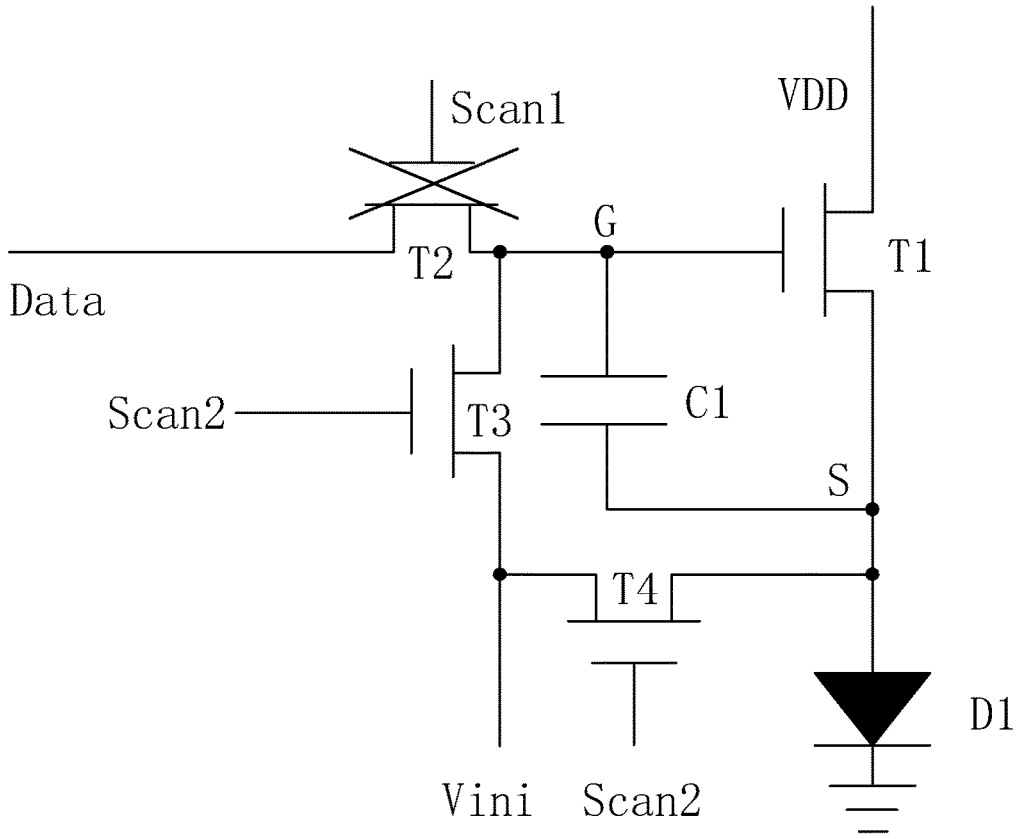
FIG. 3 is a schematic view showing the operation condition of the pixel internal driver circuit when executing Step 2 of the hybrid compensation method for OLED pixel provided by an embodiment of the present invention.

Referring to FIGS. 2-3, the first scan signal Scan1 provides low voltage to cut off the second TFT T2, the second scan signal Scan2 provides high voltage to turn on the third TFT T3 and the fourth TFT T4, and the data signal Data provides low voltage. The initialization voltage Vini is written into the first node G (i.e., the gate of the first TFT T1) and the second node S (i.e., the source of the first TFT T1) via the third and fourth TFTs T3, T4. In other words, the initialization voltage Vini is written into the gate and source of the first TFT, which is the driving TFT, to reset the gate voltage of the first TFT T1.

Step 3: entering threshold voltage detection phase 2.

Figure 4:
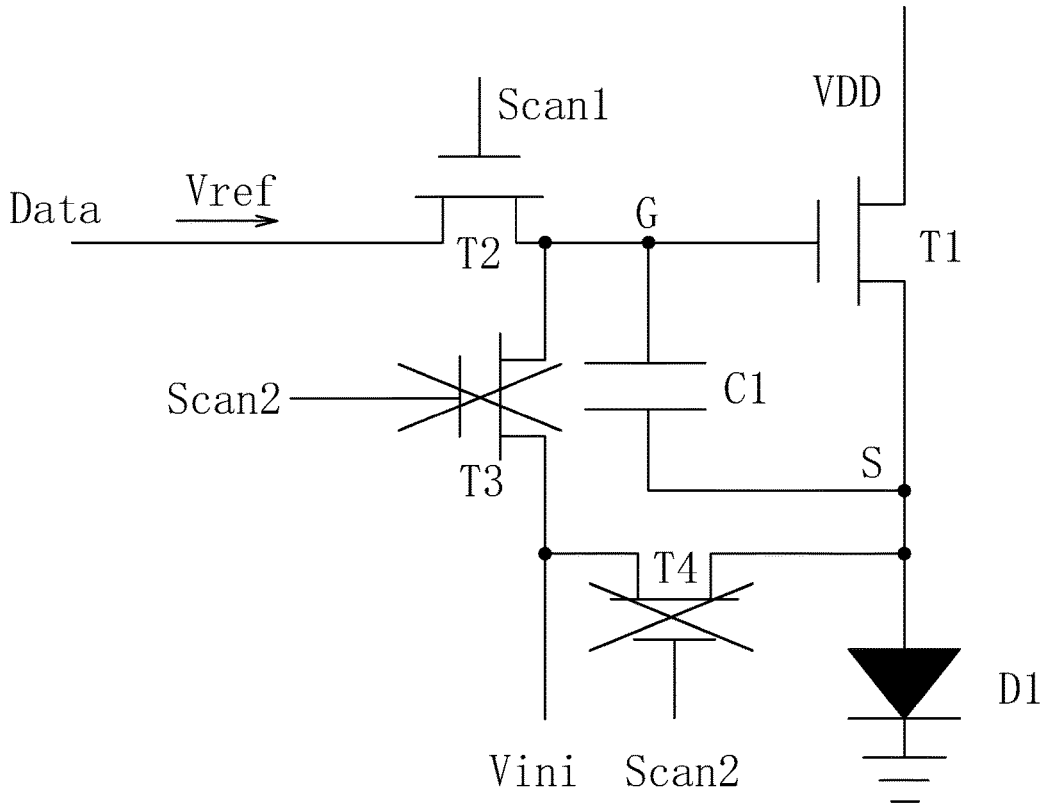
FIG. 4 is a schematic view showing the operation condition of the pixel internal driver circuit when executing Step 3 of the hybrid compensation method for OLED pixel provided by an embodiment of the present invention.

Referring to FIG. 2 and FIG. 4, the first scan signal Scan1 provides high voltage to turn on the second TFT T2, the second scan signal Scan2 provides low voltage to cut off the third TFT T3 and the fourth TFT T4, the data signal Data provides a reference high voltage Vref, the first node G (i.e., the gate of the first TFT T1) is written into with the reference high voltage Vref and, with a source follow approach, the second node S(i.e., the source of the first TFT T2) becomes Vref−Vth, wherein Vth is the threshold voltage of the first TFT T1.

Step 4: threshold voltage programming design phase 3.

Figure 5:
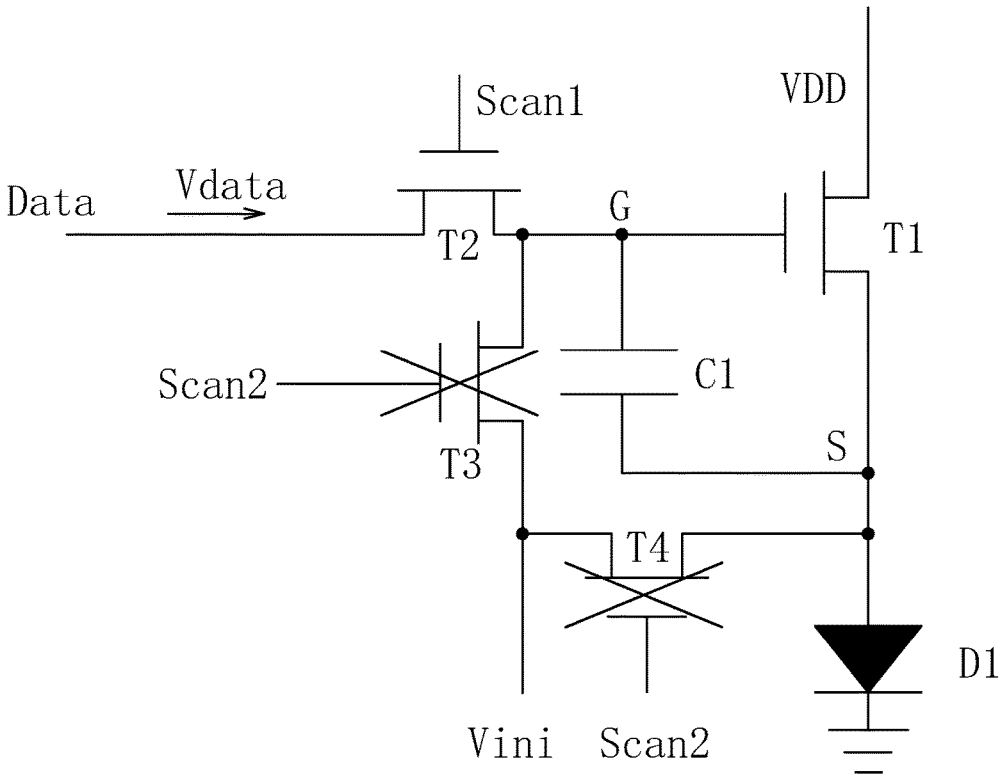
FIG. 5 is a schematic view showing the operation condition of the pixel internal driver circuit when executing Step 4 of the hybrid compensation method for OLED pixel provided by an embodiment of the present invention.

Referring to FIG. 2 and FIG. 5, the first scan signal Scan1 provides high voltage to turn on the second TFT T2, the second scan signal Scan2 provides low voltage to cut off the third TFT T3 and the fourth TFT T4, the data signal Data provides a display data signal high voltage Vdata, the first node G (i.e., the gate of the first TFT T1) is written into with the display data signal high voltage Vdata and the second node S (i.e., the source of the first TFT T1) becomes Vref−Vth+ΔV, wherein ΔV is influence on the second node caused by the display data signal high voltage, and is only related to the display data signal high voltage Vdata and the equivalent capacitance of OLED D1, and not related o the threshold voltage of the first TFT T1.

Specifically, the reference high voltage Vref is lower than the display data signal high voltage Vdata.

Step 5: entering driving light-emitting phase 4.

Figure 6:
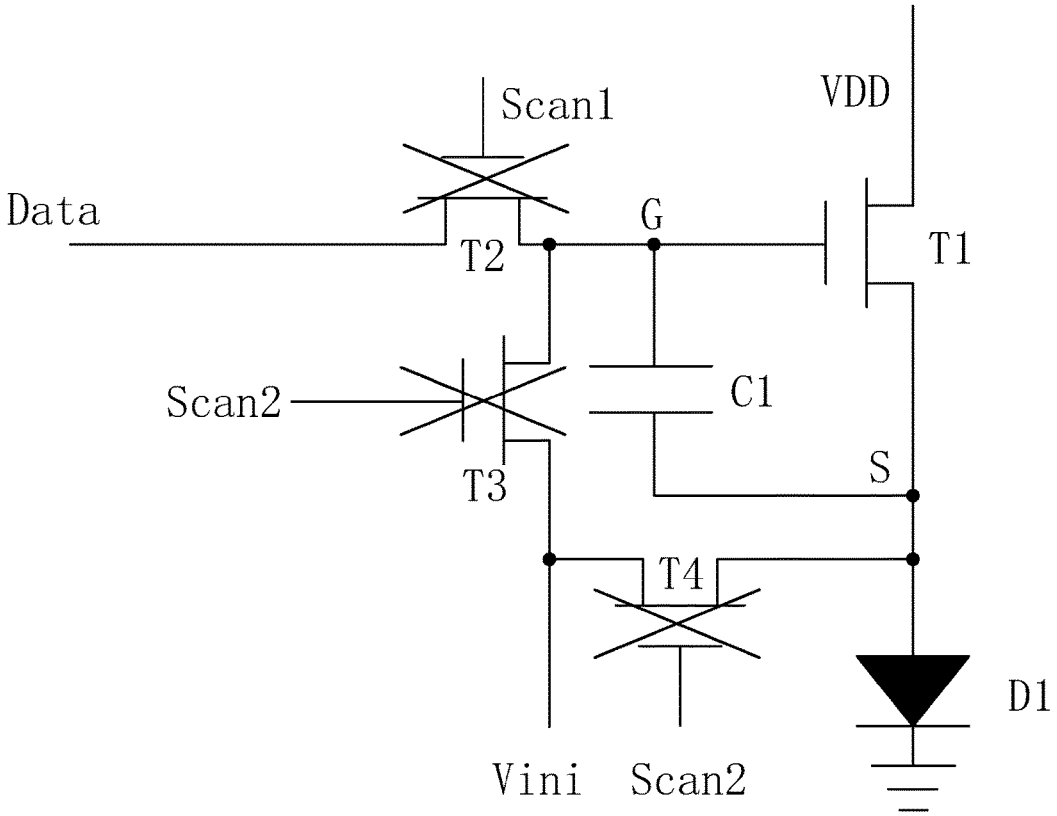
FIG. 6 is a schematic view showing the operation condition of the pixel internal driver circuit when executing Step 5 of the hybrid compensation method for OLED pixel provided by an embodiment of the present invention.

Referring to FIG. 2 and FIG. 6, the first scan signal Scan1, the second scan signal Scan2 and the data signal Data all provide low voltage, the second TFT T2, the third TFT T3 and the fourth TFT T4 are all cut off, the voltage difference between the first node G and the second node S remains unchanged due to storage effect of the first capacitor C1. In other words, the voltage between the gate and the source of the first TFT T1 remains unchanged, and the OLED d1 emits light.

Moreover, the equation to compute the current flowing through the OLED is known as:

$$I=1/2Cox(\mu W/L)\ (Vgs-Vth)^2 \quad (1)$$

Wherein I is the current flowing through the OLED, μ is the carrier migration rate of the driving TFT, W and L are the width and length of channel of the driving TFT, Vgs is the voltage difference between the gate and the source of the driving TFT, and Vth is the threshold voltage of the driving TFT.

And, $$Vgs==V\text{data}-(V\text{ref}-Vth+\Delta V) \quad (2)$$

Substituting (2) into equation (1) to obtain:

$$I=1/2Cox(\mu W/L)(V\text{data}-V\text{ref}+Vth-\Delta V-Vth)^2$$

$$=1/2Cox(\mu W/L)(V\text{data}-Vref-\Delta V)^2$$

As shown, the current flowing through the OLED D1 is independent of the threshold voltage of the first TFT T1, which achieves effective compensation for the threshold voltage change in the first TFT T1, Also, because the pixel internal driver circuit 100 uses internal compensation, the compensation speed is fast to ensure the luminance evenness of the OLED and improve the display result.

In Step 5, the ADC 210 of the external compensation circuit 200 also receives the current flowing through the OLED D1 by the corresponding row of pixel internal driver circuits 100, and the ADC 210 converts the current to obtain an actual current detection signal. The current comparator 220 compares the actual current detection signal with a pre-defined current corresponding signal. When a difference exists, the control module 230 computes the difference between the actual current detection signal and the pre-defined current corresponding signal and stores the difference in the memory 240.

In addition, in Step 5, the current flowing through the OLED D1 by the corresponding row of pixel internal driver circuits 100 is amplified by the operational amplifier 260 and then outputted to the input end of the ADC 210.

Step 6: when the corresponding row of pixel internal driver circuits 100 enters the threshold voltage programming design phase 3 again, the memory 240 outputs the stored difference to the DAC 250 for conversion to perform compensation on the data signal Data so that the current flowing through the OLED d1 is closer to the pre-defined current. Because the external compensation circuit uses external compensation approach, the compensation range is large and able to rectify the compensation result of the pixel internal driver circuit 100 to further ensure the luminance evenness of the OLED and improve display quality.

In summary, the present invention provides a hybrid compensation circuit and method for OLED pixel, by using a pixel internal driver circuit of 4T1C structure to compensate threshold voltage of driving TFT using the source follow approach to achieve fast compensation; and in driving light-emitting phase, using an external compensation circuit to detect the current flowing through the OLED, comparing, computing and storing the difference between the current flowing through the OLED and a pre-defined current; when the corresponding row of pixel internal driver circuits entering the threshold voltage programming design phase again, performing compensation on the data signal, correcting compensation result so that the current flowing through the OLED is closer to the pre-defined current to achieve large compensation range.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the clams of the present invention.

What is claimed is:

1. A hybrid compensation circuit for OLED pixel, which comprises: a plurality of pixel internal driver circuits arranged in an array, and an external compensation circuit electrically connected respectively to each row of the plurality of pixel internal driver circuits;

each pixel internal driver circuit comprising: a first thin film transistor (TFT), a second TFT, a third TFT, a fourth TFT, a first capacitor, and an organic light-emitting diode (OLED);

the first TFT having the gate connected to a first node, the source connected to a second node and the drain connected to a voltage power supply;

the second TFT having the gate connected to a first scan signal, the source connected to a data signal and the drain connected to the first node;

the third TFT having the gate connected to a second scan signal, the source connected to an initialization voltage and the drain connected to the first node;

the fourth TFT having the gate connected to the second scan signal, the source connected to the initialization voltage and the drain connected to the second node;

the first capacitor having one end connected to the first node and the other end connected to the second node;

the OLED having the anode connected to the second node and the cathode connected to the ground;

each external compensation circuit comprising: an analog-to-digital converter (ADC), a current comparator, a control module, a memory, and a digital-to-analog converter (DAC);

the ADC having the input end connected to the drain of the first TFT of corresponding row of pixel internal driver circuits, and the output end connected to the input end of the current comparator;

the current comparator having the output end connected to the input end of the control module;

the control module having the output end connected to the input end of the memory;

the memory having the output end connected to the input end of the DAC; and the DAC having the output end connected to the source of the second TFT of corresponding row of pixel internal driver circuits.

2. The hybrid compensation circuit for OLED pixel as claimed in claim 1, wherein the external compensation circuit further comprises an operational amplifier and a second capacitor;

the operational amplifier having the first input end connected to the drain of the first TFT of the pixel internal driver circuit, the second input end connected to the ground, and the output end connected to the input end of the ADC;

the second capacitor having one end connected to the first input end of the operational amplifier and the other end connected to the output end of the operational amplifier.

3. The hybrid compensation circuit for OLED pixel as claimed in claim 1, wherein the first TFT, the second TFT, the third TFT and the fourth TFT are all low temperature polysilicon (LTPS) TFTs, oxide semiconductor TFTs or amorphous silicon (a-Si) TFTs;

the first scan signal and the second scan signal are both provided by an external timing controller.

4. The hybrid compensation circuit for OLED pixel as claimed in claim 1, wherein the first scan signal, the second scan signal and the data signal are combined to correspond, in series, to a reset phase, a threshold voltage detection phase, a threshold voltage programming design phase and a driving light-emitting phase;

in the reset phase, the first scan signal provides low voltage, the second scan signal provides high voltage and the data signal provides low voltage;

in the threshold voltage detection phase, the first scan signal provides high voltage, the second scan signal provides low voltage and the data signal provides a reference high voltage;

in the threshold voltage programming design phase, the first scan signal provides high voltage, the second scan signal provides low voltage and the data signal provides a display data signal high voltage;

in the driving light-emitting phase, the first scan signal, the second scan signal and the data signal all provide low voltage.

5. The hybrid compensation circuit for OLED pixel as claimed in claim 4, wherein the reference high voltage is lower than the display data signal high voltage.

6. A hybrid compensation method for OLED pixel, which comprises:

Step 1: providing a hybrid compensation circuit for OLED pixel, which comprising: a plurality of pixel internal driver circuits arranged in an array, and an external compensation circuit electrically connected respectively to each row of the plurality of pixel internal driver circuits;

each pixel internal driver circuit comprising: a first thin film transistor (TFT), a second TFT, a third TFT, a fourth TFT, a first capacitor, and an organic light-emitting diode (OLED);

the first TFT having the gate connected to a first node, the source connected to a second node and the drain connected to a voltage power supply;

the second TFT having the gate connected to a first scan signal, the source connected to a data signal and the drain connected to the first node;

the third TFT having the gate connected to a second scan signal, the source connected to an initialization voltage and the drain connected to the first node;

the fourth TFT having the gate connected to the second scan signal, the source connected to the initialization voltage and the drain connected to the second node;

the first capacitor having one end connected to the first node and the other end connected to the second node;

the OLED having the anode connected to the second node and the cathode connected to the ground;

each external compensation circuit comprising: an analog-to-digital converter (ADC), a current comparator, a control module, a memory, and a digital-to-analog converter (DAC);

the ADC having the input end connected to the drain of the first TFT of corresponding row of pixel internal driver circuits, and the output end connected to the input end of the current comparator;

the current comparator having the output end connected to the input end of the control module;

the control module having the output end connected to the input end of the memory;

the memory having the output end connected to the input end of the DAC; and the DAC having the output end connected to the source of the second TFT of corresponding row of pixel internal driver circuits;

Step 2: entering reset phase:

the first scan signal providing low voltage to cut off the second TFT, the second scan signal providing high voltage to turn on the third TFT and the fourth TFT, the initialization voltage being written into the first node (i.e., the gate of the first TFT) and the second node (i.e., the source of the first TFT), and the data signal providing low voltage;

Step 3: entering threshold voltage detection phase:

the first scan signal providing high voltage to turn on the second TFT, the second scan signal providing low voltage to cut off the third TFT and the fourth TFT, the data signal providing a reference high voltage Vref, the first node (i.e., the gate of the first TFT) being written into with the reference high voltage and the second node (i.e., the source of the first TFT) becoming Vref−Vth, with Vth being the threshold voltage of the first TFT;

Step 4: entering threshold voltage programming design phase:

the first scan signal providing high voltage to turn on the second TFT, the second scan signal providing low voltage to cut off the third TFT and the fourth TFT, the data signal providing a display data signal high voltage, the first node (i.e., the gate of the first TFT) being written into with the display data signal high voltage and the second node (i.e., the source of the first TFT) becoming Vref−Vth+ΔV, with ΔV being influence on the second node caused by the display data signal high voltage;

Step 5: entering driving light-emitting phase:

the first scan signal, the second scan signal and the data signal all providing low voltage, the second TFT, the third TFT and the fourth TFT all cut off, the voltage difference between the first node and the second node remaining unchanged due to storage effect of the first capacitor; the OLED emitting light and current flowing through the OLED independent of the threshold voltage of the first TFT;

the ADC also receiving and converting the current flowing through the OLED by the corresponding row of pixel internal driver circuits to obtain an actual current detection signal, the current comparator comparing the actual current detection signal with a pre-defined current corresponding signal, the control module computing the difference between the actual current detection signal and the pre-defined current corresponding signal and storing the difference in the memory;

Step 6: when the corresponding row of pixel internal driver circuits entering the threshold voltage programming design phase again, the memory outputting the stored difference to the DAC for conversion and performing compensation on the data signal.

7. The hybrid compensation method for OLED pixel as claimed in claim 6, wherein the external compensation circuit further comprises an operational amplifier and a second capacitor;

the operational amplifier has the first input end connected to the drain of the first TFT of the pixel internal driver circuit, the second input end connected to the ground, and the output end connected to the input end of the ADC;

the second capacitor having one end connected to the first input end of the operational amplifier and the other end connected to the output end of the operational amplifier;

in Step 5, the current flowing the OLED by the corresponding row of pixel internal driver circuits is amplified by the operational amplifier and outputted to the input end of the ADC.

8. The hybrid compensation method for OLED pixel d as claimed in claim 6, wherein the first TFT, the second TFT and the third TFT are all low temperature polysilicon (LTPS) TFTs, oxide semiconductor TFTs or amorphous silicon (a-Si) TFTs;

the first scan signal and the second scan signal are both provided by an external timing controller.

9. The hybrid compensation method for OLED pixel as claimed in claim 6, wherein the reference high voltage is lower than the display data signal high voltage.

10. A hybrid compensation circuit for OLED pixel, which comprises: a plurality of pixel internal driver circuits arranged in an array, and an external compensation circuit electrically connected respectively to each row of the plurality of pixel internal driver circuits;

each pixel internal driver circuit comprising: a first thin film transistor (TFT), a second TFT, a third TFT, a fourth TFT, a first capacitor, and an organic light-emitting diode (OLED);

the first TFT having the gate connected to a first node, the source connected to a second node and the drain connected to a voltage power supply;

the second TFT having the gate connected to a first scan signal, the source connected to a data signal and the drain connected to the first node;

the third TFT having the gate connected to a second scan signal, the source connected to an initialization voltage and the drain connected to the first node;

the fourth TFT having the gate connected to the second scan signal, the source connected to the initialization voltage and the drain connected to the second node;

the first capacitor having one end connected to the first node and the other end connected to the second node;

the OLED having the anode connected to the second node and the cathode connected to the ground;

each external compensation circuit comprising: an analog-to-digital converter (ADC), a current comparator, a control module, a memory, and a digital-to-analog converter (DAC);

the ADC having the input end connected to the drain of the first TFT of corresponding row of pixel internal driver circuits, and the output end connected to the input end of the current comparator;

the current comparator having the output end connected to the input end of the control module;

the control module having the output end connected to the input end of the memory;

the memory having the output end connected to the input end of the DAC; and the DAC having the output end connected to the source of the second TFT of corresponding row of pixel internal driver circuits;

the external compensation circuit further comprising an operational amplifier and a second capacitor;

the operational amplifier having the first input end connected to the drain of the first TFT of the pixel internal driver circuit, the second input end connected to the ground, and the output end connected to the input end of the ADC;

the second capacitor having one end connected to the first input end of the operational amplifier and the other end connected to the output end of the operational amplifier;

wherein the first TFT, the second TFT, the third TFT and the fourth TFT are all low temperature polysilicon (LTPS) TFTs, oxide semiconductor TFTs or amorphous silicon (a-Si) TFTs;

the first scan signal and the second scan signal are both provided by an external timing controller.

11. The hybrid compensation circuit for OLED pixel as claimed in claim 10, wherein the first scan signal, the second scan signal and the data signal are combined to correspond, in series, to a reset phase, a threshold voltage detection phase, a threshold voltage programming design phase and a driving light-emitting phase;

in the reset phase, the first scan signal provides low voltage, the second scan signal provides high voltage and the data signal provides low voltage;

in the threshold voltage detection phase, the first scan signal provides high voltage, the second scan signal provides low voltage and the data signal provides a reference high voltage;

in the threshold voltage programming design phase, the first scan signal provides high voltage, the second scan signal provides low voltage and the data signal provides a display data signal high voltage;

in the driving light-emitting phase, the first scan signal, the second scan signal and the data signal all provide low voltage.

12. The hybrid compensation circuit for OLED pixel as claimed in claim 10, wherein the reference high voltage is lower than the display data signal high voltage.

* * * * *